US010087905B2

(12) United States Patent
Budden

(10) Patent No.: US 10,087,905 B2
(45) Date of Patent: Oct. 2, 2018

(54) METHOD AND APPARATUS FOR STARTING A SMALL COMBUSTION ENGINE

(71) Applicant: Doyle Budden, Fort McMurray (CA)

(72) Inventor: Doyle Budden, Fort McMurray (CA)

( * ) Notice: Subject to any disclaimer, the term of this patent is extended or adjusted under 35 U.S.C. 154(b) by 0 days.

(21) Appl. No.: 15/655,659

(22) Filed: Jul. 20, 2017

(65) Prior Publication Data

US 2017/0363056 A1 Dec. 21, 2017

(51) Int. Cl.

| | |
|---|---|
| ***F02N 11/12*** | (2006.01) |
| ***F02B 63/02*** | (2006.01) |
| ***F02N 1/00*** | (2006.01) |

(52) U.S. Cl.

CPC ..... *F02N 11/12* (2013.01); *F02B 63/02* (2013.01); *F02N 1/00* (2013.01)

(58) Field of Classification Search

CPC . F02N 11/12; F02N 1/00; F02B 63/02; H05K 999/99

See application file for complete search history.

(56) References Cited

U.S. PATENT DOCUMENTS

| | | | |
|---|---|---|---|
| 3,437,083 | A | 4/1969 | Hamman |
| 3,596,647 | A | 8/1971 | Heisler |
| 3,885,544 | A | 5/1975 | Pfeiffer |
| 4,135,301 | A | 1/1979 | Hoeppner |
| 4,365,596 | A | 12/1982 | Bennett, Sr. |
| 4,372,263 | A | 2/1983 | Costa |
| 4,531,482 | A | 7/1985 | Scheckel |
| 4,569,315 | A | 2/1986 | Bodnar |
| 5,345,900 | A | 9/1994 | Wisegerber |
| 7,293,330 | B2 | 11/2007 | Guip et al. |

(Continued)

FOREIGN PATENT DOCUMENTS

| | | |
|---|---|---|
| CA | 853487 | 10/1970 |
| CN | 102554348 | 7/2012 |

(Continued)

OTHER PUBLICATIONS

International Searching Authority, The International Search Report and the Written Opinion of the International Searching Authority, or the Declaration, International Application No. PCT/CA2017/051009, Filed Aug. 29, 2017, 10 pages, Receiving Office—Canadian Intellectual Property Office.

(Continued)

*Primary Examiner* — Hieu T Vo

(74) *Attorney, Agent, or Firm* — Richard D. Okimaw

(57) ABSTRACT

Disclosed is a method, apparatus and kit for starting a quick-start chainsaw. The quick-start chainsaw comprises a chainsaw having a crankshaft extending along an axis between first and second ends and a quick-start extension extending along the axis from the second end adapted to engage with and be rotated by a socket. The quick-start chainsaw further comprises a casing with a hole therethrough aligned with the axis providing access to the quick-start extension therethrough. The method comprises securing the socket to a portable drill, locating the socket within the hole and connecting the socket with the quick-start extension. The method further comprises rotating the socket and the quick-start extension around the axis with the portable drill thereby rotating the crankshaft and starting a combustion engine. The kit comprises a quick-start chainsaw and a socket rotatable by a portable drill.

11 Claims, 3 Drawing Sheets

(56) References Cited

U.S. PATENT DOCUMENTS

| | | | |
|---|---|---|---|
| 7,530,340 | B1 | 5/2009 | Jellinek et al. |
| 8,490,592 | B1 | 7/2013 | Von Tiergen |
| 2011/0126790 | A1 | 6/2011 | Vacek |

FOREIGN PATENT DOCUMENTS

| | | |
|---|---|---|
| CN | 103967680 | 8/2014 |
| CN | 204099097 | 1/2015 |
| DE | 3702882 | 8/1988 |
| DE | 8913081 | 1/1990 |
| DE | 4134543 | 10/1992 |
| DE | 102005009975 | 12/2006 |
| EP | 3147494 | 3/2017 |
| GB | 2160931 | 1/1988 |
| JP | 2006336522 | 12/2006 |
| JP | 2011043081 | 3/2011 |
| WO | 2015129357 | 3/2015 |
| WO | 2017091950 | 6/2017 |

OTHER PUBLICATIONS

International Searching Authority, The International Search Report and the Written Opinion of the International Searching Authority, or the Declaration, International Application No. PCT/CA2018/050297, filed Mar. 12, 2018, 9 pages, Receiving Office—Canadian Intellectual Property Office.

METHOD AND APPARATUS FOR STARTING A SMALL COMBUSTION ENGINE

BACKGROUND OF THE INVENTION

1. Field of Invention

The present invention relates generally to small internal combustion engines and in particular to a method and apparatus to facilitate starting a combustion engine.

2. Description of Related Art

Small internal combustion engines are used on a variety of tools, including lawn mowers, weed trimmers, outboard motors, snow blowers, chainsaws and the like. It is common to manually start the engine with a starter pullcord system. Problems with this system can arise when a motor is cold or if the spark plug is dirty. Some users are not physically capable of pulling the pullcord with sufficient force and speed to start the engine.

SUMMARY OF THE INVENTION

According to a first embodiment of the present invention there is disclosed a quick-start chainsaw comprising a chainsaw having a crankshaft extending along an axis between first and second ends, a quick-start extension extending along the axis from the second end adapted to engage with and be rotated by a socket; and wherein the quick-start chainsaw includes a casing with a hole therethrough aligned with the axis providing access to the quick-start extension therethrough.

The quick-start extension may be formed with an external surface selected to engage within the socket. The hole may be sized to receive the socket therethrough. The extension may be located within the hole. The external surface may be a hexagonal shape.

The quick-start extension may be formed with external threading. The quick-start chainsaw may further comprise a nut securable upon the external threading, the nut forming the external surface of the quick start extension. The nut may be welded on to the quick start extension.

The quick-start chainsaw may further comprise a cover adapted to close the hole.

According to a further embodiment of the present invention there is disclosed a method for starting a quick-start chainsaw comprising securing a socket to a portable drill, locating the socket within a hole aligned along an axis with a crankshaft extending along the axis in a chainsaw casing, connecting the socket with a quick-start extension extending along the axis from a second end of the crankshaft and rotating the socket and the quick-start extension around the axis with the portable drill thereby rotating the crankshaft and starting a combustion engine.

According to a further embodiment of the present invention there is disclosed a quick-start chainsaw kit comprising a chainsaw having a crankshaft extending along an axis between first and second ends, a socket rotatable by a portable drill, a quick-start extension extending along the axis from the second end adapted to engage with and be rotated by the socket and a casing with a hole therethrough aligned with the axis providing access to the quick-start extension therethrough.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 2:
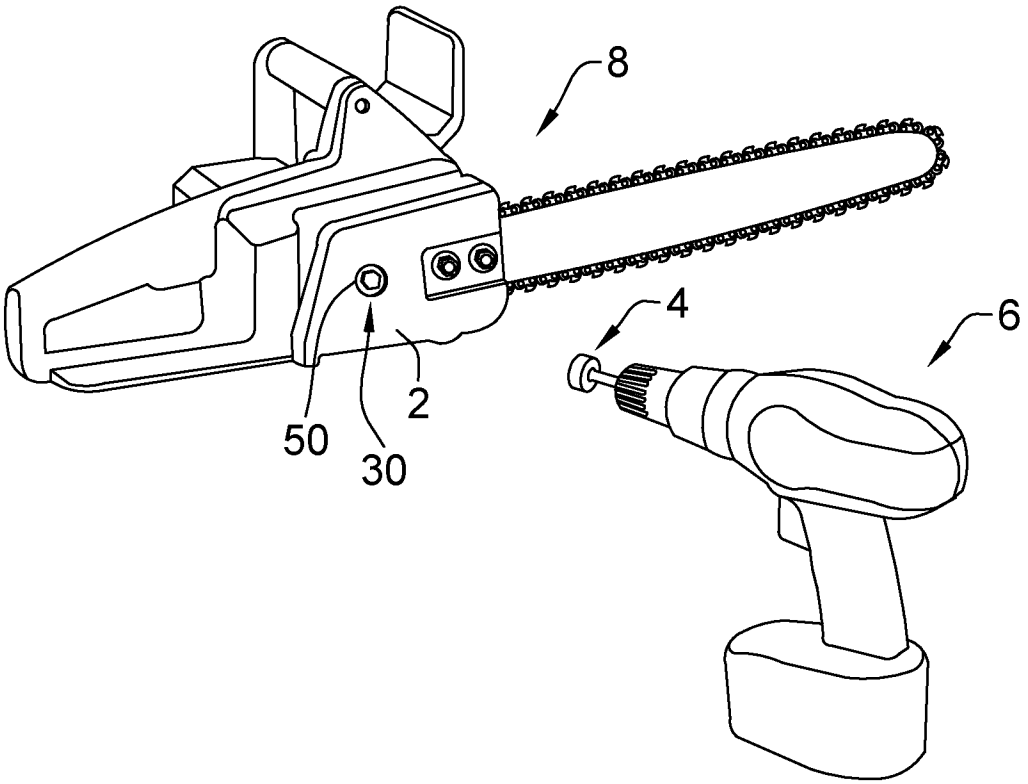
FIG. 2 is a perspective view of a chainsaw having a crankshaft extension according to a first embodiment of the present invention, with a portable hand drill.

Referring to FIG. 2, an apparatus for extending a crankshaft of an internal combustion engine to facilitate engine start according to a first embodiment of the invention is shown generally at 30. The apparatus 30 is connected to a standard crankshaft, as will be described further below, within a chainsaw 8.

Figure 1:
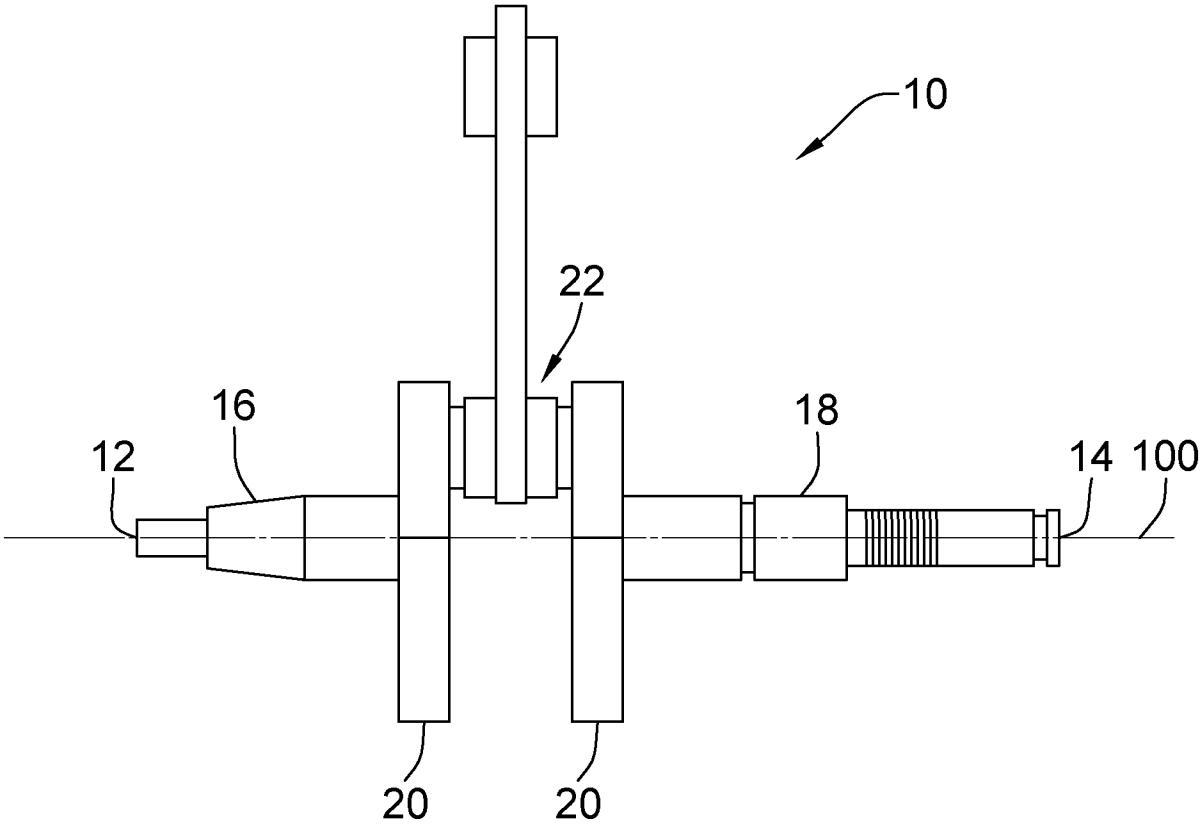
Figure 1 Prior Art
FIG. 1 is a side view of a prior art crankshaft.

Turning now to FIG. 1, a prior art crankshaft is shown generally at 10. The crankshaft extends along an axis 100 between first and second ends, 12 and 14, respectively, and includes a first half shaft 16 proximate to the first end 12 and a second half shaft 18 proximate to the second end 14. The first and second half shafts, 16 and 18, respectively, are joined with a pair of counterweights 20 connected by a crank pin 22 therebetween, as is commonly known.

Figure 3:
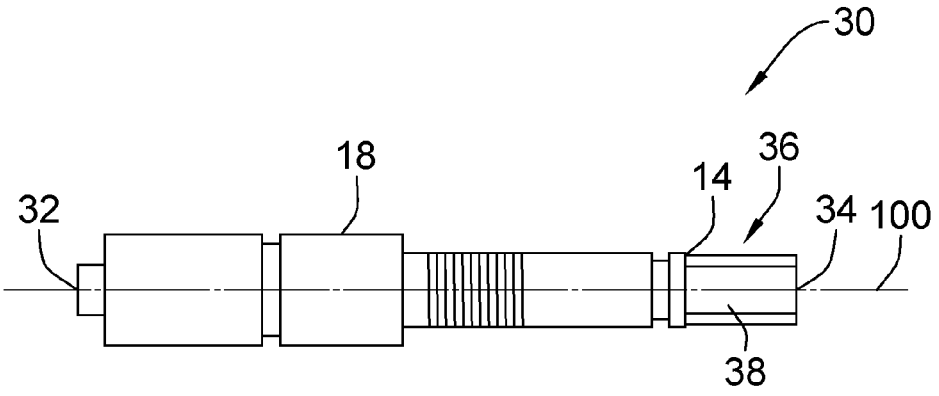
FIG. 3 is a side view of the crankshaft extension of FIG. 2.

Referring to FIG. 3, the apparatus 30 extends along the axis 100 between first and second ends, 32 and 34, respectively and includes a second half shaft 18, as is commonly known, extending from the first end 32 to the second half shaft second end 14, with an extension 36 extending between the second ends 14 and 34. The extension 36 may be such as, by way of non-limiting example, ½" in length between the second ends 14 and 34 and may be co-formed with the second half shaft 18 during manufacture. Optionally, the extension 36 may also be formed separately from the second half shaft 18 through any known method, such as, by way of non-limiting example, welding, adhesives, threading or the like. The extension 36 includes an outer surface 38 adapted to engage with a standard socket, as will be set out in more detail below. The extension 36 may have a hexagonal cross-section, and be formed with the same profile as a standard sized bolt to fit a 9 mm socket, as is commonly known, although it will be appreciated that other cross-sectional shapes, such as, by way of non-limiting example, square or octagonal, may be useful, as well.

Figure 4:
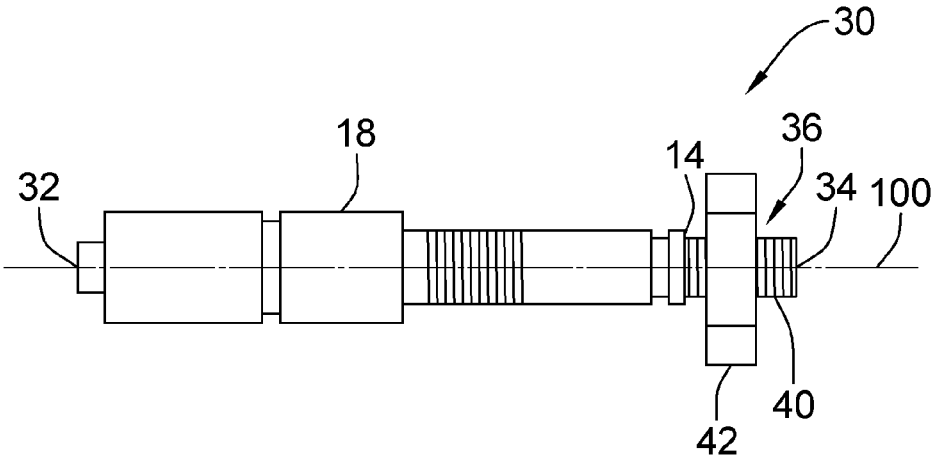
FIG. 4 is a side view of a crankshaft extension according to a further embodiment.

FIG. 4 illustrates a further embodiment of the apparatus 30 wherein the extension 36 includes external threading 40 thereon. The threading 40 is selected to receive a standard nut 42 thereon. The nut 42 may be a hexagonal 19 mm nut, as is commonly known, although it will be appreciated that other nut sizes may be useful, as well. The nut 42 is threaded onto the extension 36 for operation of the apparatus 30.

Turning back to FIG. 2, when installed on the crankshaft of a chainsaw 8, the apparatus 30 may be used to facilitate engine start without the use of a pullcord, as is commonly known. The apparatus 30 is accessible through a hole 50 in the chainsaw casing 2, as is commonly known. A removable protective cover (not shown) may be provided to cover the hole 50 for safety purposes when the chainsaw is in use. A portable hand drill 6 is set up with a standard socket drill bit 4, as is commonly known, selected to engage with the extension 36, as outlined above, or with the nut 42 of the further embodiment design. With the drill in forward drive, the socket drill bit 4 is engaged upon the apparatus 30, then the drill is activated, as is commonly known, thereby rapidly rotating the crankshaft 10 about the axis 100 and starting the engine, as is commonly known. Upon engine ignition, the socket drill bit 4 is disengaged from the apparatus 30, and the protective cover placed over the hole 50.

While specific embodiments of the invention have been described and illustrated, such embodiments should be considered illustrative of the invention only and not as limiting the invention as construed in accordance with the accompanying claims.

What is claimed is:

1. A quick-start chainsaw comprising:

a chainsaw having a crankshaft extending along an axis between first and second ends;

a quick-start extension extending along said axis from said second end adapted to engage with and be rotated by a socket; and wherein said quick-start chainsaw includes a casing with a hole therethrough aligned with said axis providing access to said quick-start extension therethrough.

2. The quick-start chainsaw of claim 1 wherein said quick-start extension is formed with an external surface selected to engage within said socket.

3. The quick-start chainsaw of claim 2 wherein said hole is sized to receive said socket therethrough.

4. The quick-start chainsaw of claim 3 wherein said extension is located within said hole.

5. The quick-start chainsaw of claim 2 wherein said external surface is a hexagonal shape.

6. The quick-start chainsaw of claim 2 wherein said quick-start extension is formed with external threading.

7. The quick-start chainsaw of claim 6 further comprising a nut securable upon said external threading, said nut forming said external surface of said quick start extension.

8. The quick-start chainsaw of claim 7 wherein said nut is welded on to said quick start extension.

9. The quick-start chainsaw of claim 1 further comprising a cover adapted to close said hole.

10. A method for starting a quick-start chainsaw comprising:

securing a socket to a portable drill;

locating said socket within a hole aligned along an axis with a crankshaft extending along said axis in a chainsaw casing;

connecting said socket with a quick-start extension extending along said axis from a second end of said crankshaft; and rotating said socket and said quick-start extension around said axis with said portable drill thereby rotating said crankshaft and starting a combustion engine.

11. A quick-start chainsaw kit comprising:

a chainsaw having a crankshaft extending along an axis between first and second ends;

a socket rotatable by a portable drill;

a quick-start extension extending along said axis from said second end adapted to engage with and be rotated by said socket; and a casing with a hole therethrough aligned with said axis providing access to said quick-start extension therethrough.

* * * * *